United States Patent [19]

Satoh

[11] Patent Number: 4,545,777

[45] Date of Patent: Oct. 8, 1985

[54] DIORAMATIC RUNNING TOY

[75] Inventor: Hirohisa Satoh, Nagareyama, Japan

[73] Assignee: Takara Co., Ltd., Tokyo, Japan

[21] Appl. No.: 564,746

[22] Filed: Dec. 22, 1983

[30] Foreign Application Priority Data

Dec. 24, 1982 [JP] Japan ..... 57-197008[U]

[51] Int. Cl.[4] ..... A63H 17/26

[52] U.S. Cl. ..... 446/457; 280/1.1 R; 296/21; 446/95; 446/434; 446/471; 446/111

[58] Field of Search ..... 446/93, 94, 95, 96, 446/431, 434, 457–464, 467, 470, 471; 280/1.1 R, 1.22, 1.13; 296/1 R, 21, 25; 272/11, 12, 25, 8 D; D12/1, 18, 83, 155

[56] References Cited

U.S. PATENT DOCUMENTS

| | | | |
|---|---|---|---|
| 1,289,648 | 12/1918 | Cammack | 446/459 |
| 2,553,670 | 5/1951 | Notto | 280/1.1 R X |
| 2,590,515 | 3/1952 | Derham | 446/464 |
| 2,775,462 | 12/1956 | Biasell | 280/1.1 R |
| 3,643,375 | 2/1972 | Ginsberg et al. | 446/461 |
| 3,961,440 | 6/1976 | Saito | 446/464 |

FOREIGN PATENT DOCUMENTS

| | | | |
|---|---|---|---|
| 677961 | 8/1952 | United Kingdom | 296/1 R |
| 747034 | 3/1956 | United Kingdom | 446/462 |
| 1483751 | 8/1977 | United Kingdom | 446/466 |

*Primary Examiner*—F. Barry Shay

*Attorney, Agent, or Firm*—Joseph W. Price

[57] ABSTRACT

A dioramatic running toy including a running member and a dioramatic panel removably attached to the running member so as to enable the dioramatic panel to run with the running member. The present invention further relates to a dioramatic running toy assembly including a plurality of dioramatic running toys capable of running in combination.

3 Claims, 8 Drawing Figures

DIORAMATIC RUNNING TOY

SUMMARY OF THE INVENTION

It is an object of the present invention to provide a dioramatic running toy including a running member and a dioramatic panel attached to said running member so as to run said dioramatic panel with the running member, capable of assembling various mode of dioramatic panels with various mode of running members optionally, and further capable of connecting a plurality of dioramatic running toys in combination. The present invention seeks to offer such a dioramatic running toy to provide a variable and enjoyable toy with reality for children.

Another object of the present invention is to provide a dioramatic running toy having a simple construction economically, and easy to manufacture.

To accomplish the aforementioned objects, the present invention provides a dioramatic running toy comprising a running member including a housing and a wheel assembly rotatably mounted to said housing, a dioramatic panel having a top surface and bottom surface and provided with through holes perforated from said top surface to said bottom surface for receiving said wheel assembly therein, and connecting means for removably attaching said housing to said dioramatic panel so as to enable said dioramatic panel to run with said running member.

In accordance with another aspect of the invention, there is provided a dioramatic running toy assembly comprising at least a pair of dioramatic running toys and connecting means for removably connecting each said dioramatic running toy so as to make a dioramatic running toy assembly run in combination, each said dioramatic running toy including a running member having a housing, a wheel assembly rotatably attached to said housing and a self-contained motor assembly mounted on said housing to drive said wheel assembly, a dioramatic panel having through holes for receiving said wheel assembly therein, and attach means for removably attaching said housing to said dioramatic panel so as to enable said dioramatic panel to run with said running member.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DETAILED DESCRIPTION OF THE PREFERRED EMBODIMENTS

The following description is provided to enable any person skilled in the toy industry to make and use the present invention and sets forth the best modes contemplated by the inventor for carrying out his invention. Various modifications, however, will remain readily apparent to those skilled in the art, since the generic principles of the present invention have been defined herein specifically to provide a novel dioramatic running toy.

Figure 1:
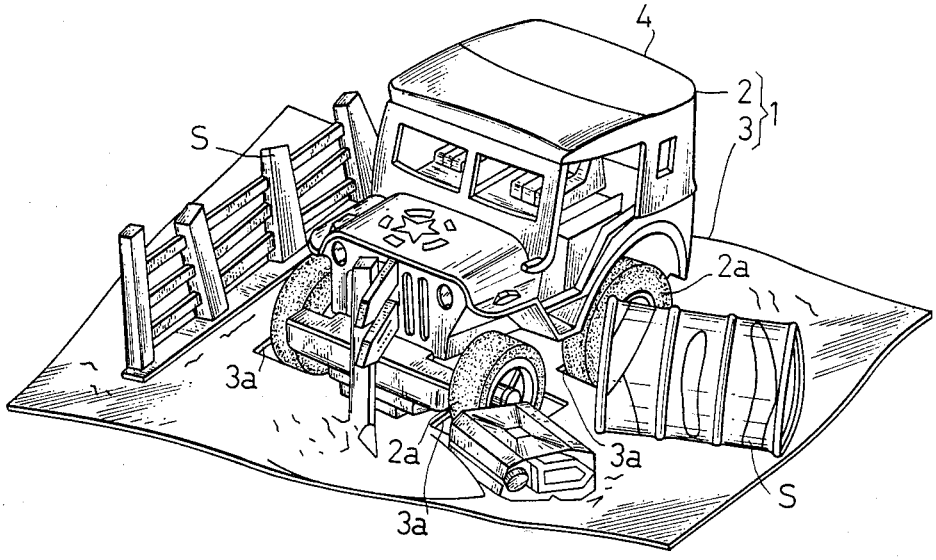
FIG. 1 is a top perspective view of a dioramatic running toy.
Figure 2:
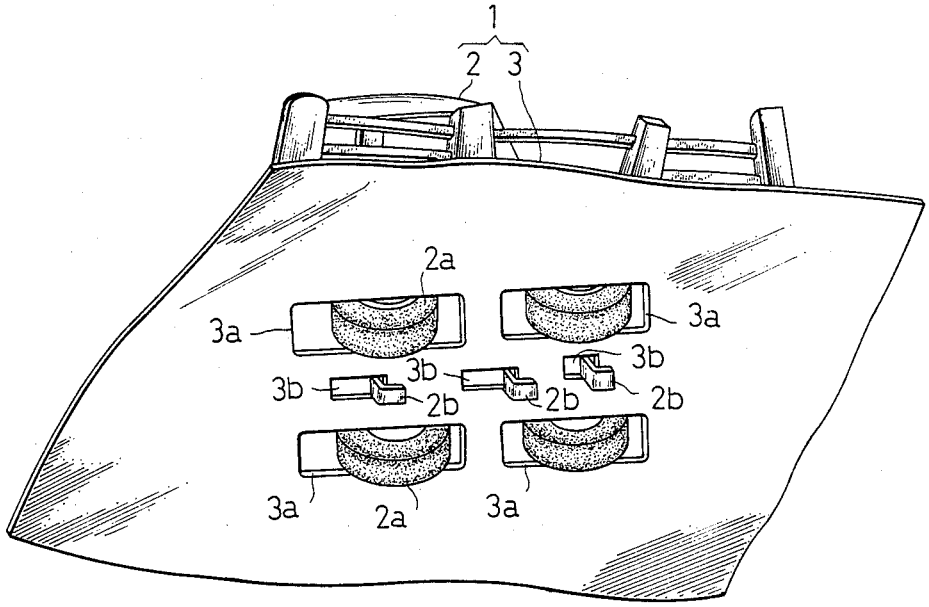
FIG. 2 is a bottom perspective view.

Referring now in detail to the drawings, FIG. 1 and FIG. 2 disclose an embodiment of the present invention. FIG. 1 is a top perspective view of a dioramatic running toy comprising a running member 2 and a dioramatic panel 3. The running member 2 includes a housing 4 and a wheel assembly 2*a* rotatably mounted on said housing 4 and driven by a prime mover, such as in the running toy disclosed in the U.S. Pat. No. 4,329,810, while the dioramatic panel 3 is removably attached to the housing 4 so as to enable the dioramatic panel 3 to run with the running member 2.

The running member 2 having a prime mover (not shown) accommodated therein, such as a well-known pull back type spring powered prime mover, is capable of running by the rotation of the wheel assmebly 2*a*, the rear wheel assembly for example, driven by the prime mover.

There are provided three L-shaped prongs 2*b* for connecting and securing the dioramatic panel 3 on the bottom surface of the housing 4 of the running member 2.

The dioramatic panel 3 is formed as a rectangular plate-like configuration, and has four holes 3*a* for rotatably receiving the wheel assembly 2*a* therein, and three receiving holes 3*b* for receiving and connecting the prongs 2*b* therein. Each of the through holes 3*a* and the receiving holes 3*b* is arranged to locate around the center of the dioramatic panel 3.

Furthermore, the dioramatic panel 3 can be provided with a decoration on its surface which, for example, simulates the scene of war corresponding to the configuration of the running member 2 simulating a military jeep as shown in FIG. 1. For that purpose, simulating members S may be adhered to the surface of the dioramatic panel 3.

The dioramatic running toy 1 is assembled by fitting the prongs 2*b* into the receiving holes 3*b*, while rotatably inserting the wheel assembly 2*a* into the through holes 3*a*, whereby connecting the dioramatic panel 3 with the running member 2.

Thus assembled, dioramatic running toy 1 is capable of running in response to the motive power of the running member 2, for example, by pushing rearward the running member on a suport surface to provide a counterclockwise rotation to said wheel assembly 2*a* to wind a spring motor assembly if a pull-back type spring powered prime mover is mounted on the running member 2.

Figure 3:
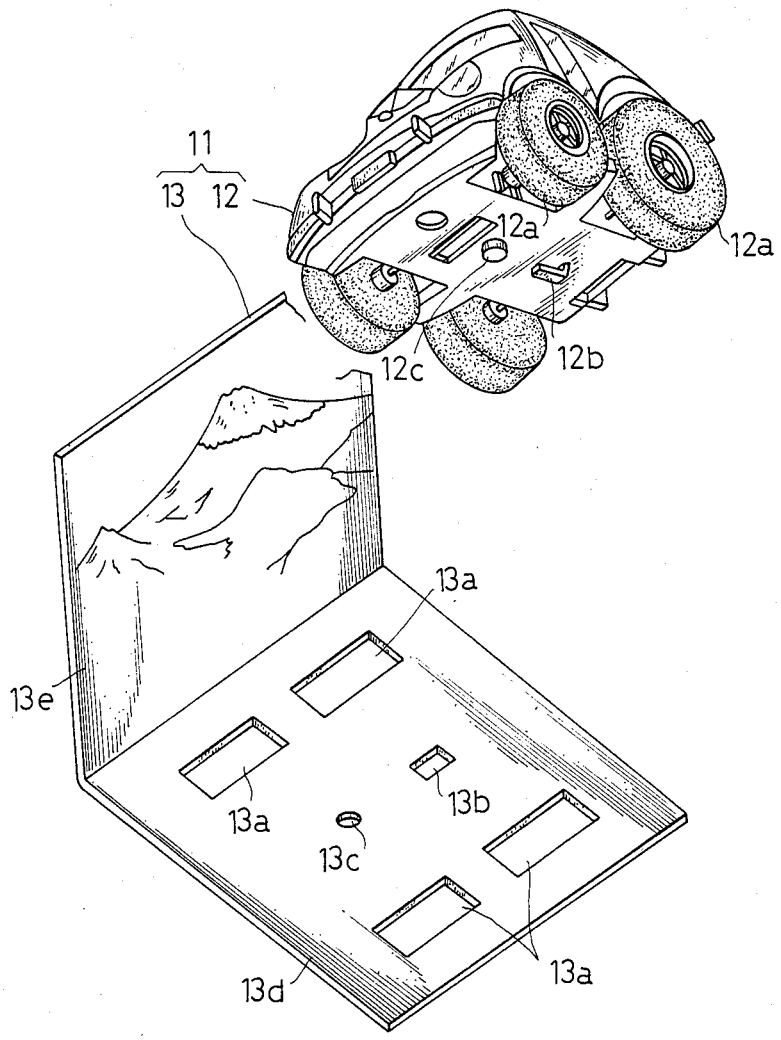
FIG. 3 is an exploded perspective view of another embodiment of the present invention.
Figure 4:
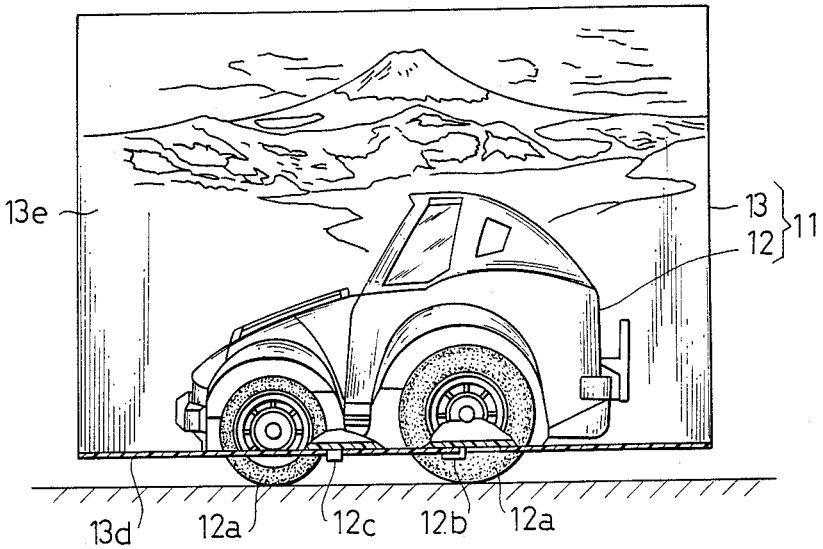
FIG. 4 is a front elevational view of the embodiment of FIG. 3.
Figure 5:
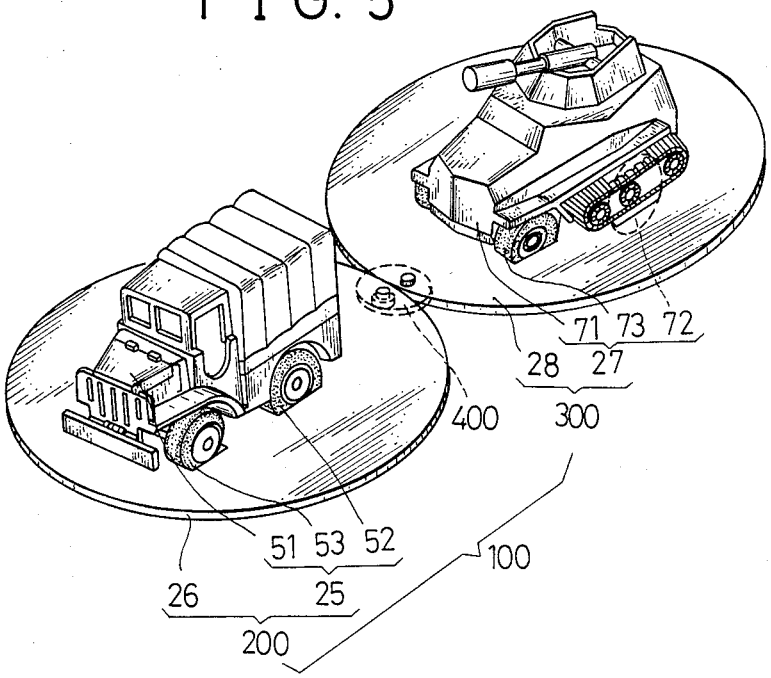
FIG. 5 is a top perspective view of a dioramatic running toy assembly of still another embodiment of the present invention.
Figure 6:
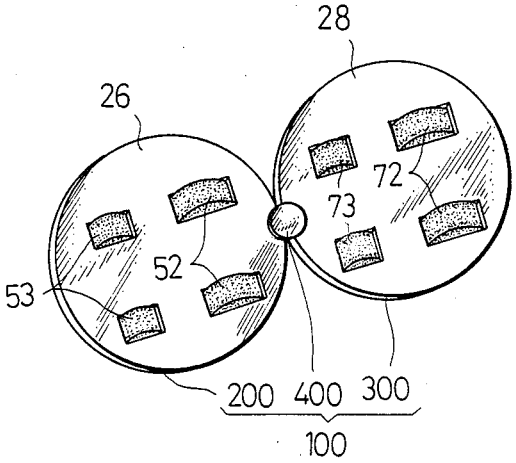
FIG. 6 is a bottom perspective view of the embodiment of FIG. 5.
Figure 7:
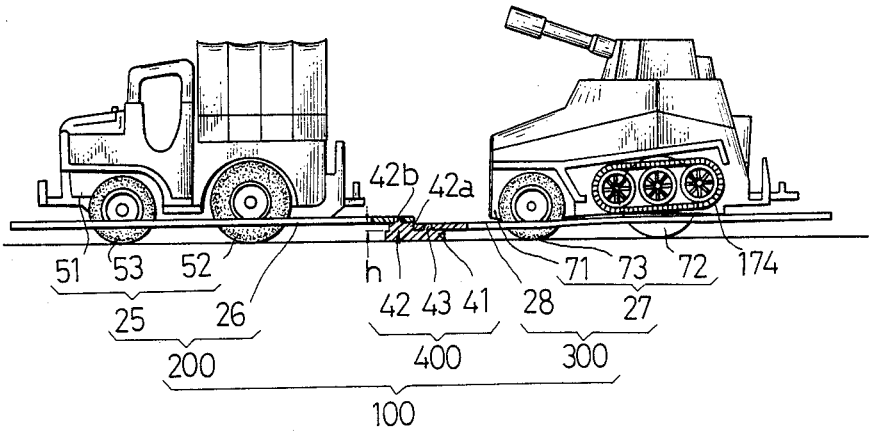
FIG. 7 is a partially sectional side view of the embodiment of FIG. 5.

FIG. 3 and FIG. 4 disclose another embodiment of the present invention, which is provided with a different construction of a dioramatic panel from aforementioned embodiment.

Namely, a dioramatic panel 13 is provided with a main plate 13*d* and a rear panel 13*e* vertically attached to the rear end of the main plate 13*d*, thereby forming an L-shaped configuration. On the front surface of the rear panel 13*e*, there is provided a background, for example, simulating a sight corresponding with the running member 12 simulating a toy sports car.

In the same way as aforementioned embodiment, a dioramatic running toy 11 is composed so as to enable the dioramatic panel 13 to run with the running member 12 by the rotation of a wheel assembly 12*a* rotatably inserted into through holes 13*a* while prongs 12*b*, 12*c* are inserted into receiving holes 13*b*, 13*c* for connecting the dioramatic panel 13 with the running member 12.

This embodiment provides more enjoyable dioramatic running toy as the dioramatic panel 13 is tridimensional.

FIG. 5–FIG. 8 disclose still another embodiment of the present invention. Numeral 100 indicates a dioramatic running toy assembly comprising dioramatic running toys 200 and 300 each including a running member and a dioramatic panel, and a connecting member 400 for connecting the dioramatic running toys 200 and 300 each other.

The dioramatic running toys 200 and 300 comprise respectively a running member 25 which simulates a military truck and a running member 27 which simulates a tank with a caterpillar-like simulating member 174 attached thereto, and dioramatic panels 26 and 28 provided with decoration on their surfaces are attached to the running members 25 and 27, respectively, so as to enable the dioramatic panels 26 and 28 to run with the running members 25 and 27.

Each running member 25, 27 mounted with a prime mover, such as a pull back type spring powered prime mover in the same manner as aforementioned embodiment, is capable of running by the rotation of each rear driving wheel assembly 52, 72, driven by the prime mover, while being accompanied by the rotation of each front idling wheel assembly 54, 73.

Each rear wheel assembly 52, 72 rotatably attached to the both sides of the rear end of the housing 51, 71 of the running member 25, 27, has a larger diameter than each front wheel assembly 53, 73, rotatably attached to the both sides of the front end of the housing 51, 71, of the running member 25, 27.

Figure 8:
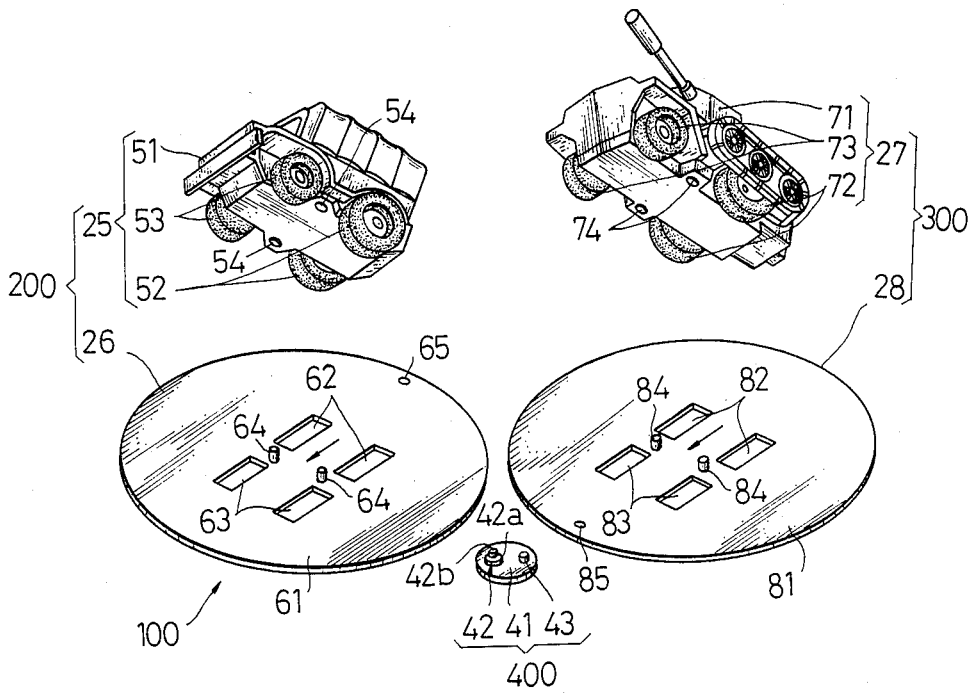
FIG. 8 is an exploded perspective view of the embodiment of FIG. 5.

On the bottom surfaces of each housing 51, 71, of the running member 25, 27, a pair of female type receptacles 54, 74, is provided about the both sides of the bottom surface and at around the center in the longitudinal direction as shown in FIG. 8.

Further, the dioramatic panels 26, 28 are formed as a disk-like configuration, and each dioramatic panel 26, 28 has two pairs of through holes about the center thereof for rotatably receiving the front and rear wheel assemblies 52, 53, 72, 73; i.e. through holes 62, 82 for receiving rear wheel assmebly 52, 72, and through holes 63, 83 for receiving front wheel assembly 53, 73, respectively.

On the surfaces of each dioramatic panel 26, 28, a pair of male type prongs 64, 84 are further provided between the through holes 62 and 63 and the through holes 82 and 83, respectively, so that the prongs 64, 84 are fitted into the receptacles 54, 74 provided on the bottom of the running members 25, 27.

The dioramatic panels 26, 28 can be provided with decorations on their surfaces such as a background simulating the scene of war corresponding to the military type running members 25, 27, for example.

The dioramatic running toys 200, 300, are assembled from the running members 25, 27, and the dioramatic panels 26, 28, by fitting the male type prongs 64, 84 into the receptacles 54, 74, while rotatably inserting the front and rear wheel assemblies 52, 54, 72, 73 into the through holes 62, 63, 82, 83, respectively.

The connecting member 400 is provided with two projections 42, 43, stuck up apart on its surface to connect the dioramatic panels 26 and 28 by inserting the projections 42, 43 respectively into connecting holes 65, 85 perforated about the edge of the dioramatic panels 26, 28. The projections 42, 43 are arranged to adjust or compensate the difference of hight between dioramatic panels 26, 28.

Each running members 25, 27, of the dioramatic running toys 200, 300, inclines forward when it is placed on a flat support surface because each rear wheel assembly 52, 72, which drives the running member 25, 27, is provided with a larger diameter than the front wheel assembly 53, 73, which idles corresponding to the rotation of the rear wheel assembly 52, 72. Accordingly, each dioramatic panel 26, 28 attached to the running member 25, 27, also inclines forward corresponding to the incline of the running member 25, 27. Such conditions cause the difference of hight h between the rear end of the dioramatic panel 26 and the front end of the dioramatic panel 28, when the dioramatic running toy 200, 300, is put on a support surface in a single file. Therefore, the connecting member 400 is arranged in tiers to adjust the difference of hight between the rear end of the dioramatic panel 26 and the front end of the dioramatic panel 28.

That is, the connecting member 400 comprises a disk-like basic plate 41, a tiered-columnar connecting projection 42 arranged on the front portion of the upper surface of the basic plate 41, and a columnar connecting projection 43 arranged on the rear portion of the upper surface of the basic plate 41.

The connecting projection 42 is arranged in tiers to correspond with the difference of height h, including a basing portion 42*a* provided on the basic plate 41 and an inserting portion 42*b* provided on the center of the basing portion 42*a*. The basing portion 42*a* having a larger diameter than that of the inserting portion 42*b*, has the same height as the difference of height h.

Further, about the edge of each dioramatic panel 26, 28, circular connecting holes 65, 85 are perforated for receiving and connecting the connecting projections 42, 43, respectively.

The dioramatic running toys 200 and 300 are connected through the connecting member 400 by inserting the connecting projections 42, 43 of the connecting member 400 into the connecting holes 42, 43, respectively.

Thus provided dioramatic running toy assembly 100 is capable of running in response to the motive power of the running members 200, 300, for example, by pushing rearward at least one of the running members 200, 300 on a support surface to wind a spring motor assembly if well-known pull back type spring powered prime movers are mounted on the running members 200, 300.

In addition to the embodiments described above, the dioramatic running toy assembly of the present invention can be also assembled to comprise more than two dioramatic running toys connected each other.

As can be readily appreciated, a dioramatic running toy of the present invention comprising a running member and a dioramatic panel removably attached to said running member so as to run said dioramatic panel with said running member, is capable of assembling various mode of dioramatic panel with various mode of running member optionally, and further capable of connecting a plurality of dioramatic running toys for providing such a dioramatic running toy which is changeful, variable, with reality, and more enjoyable for children.

Since the connecting member simply has two connecting projections arranged in tiers, a plurality of dioramatic running toys can be connected easily and firmly, adjusting the difference of height between dioramatic panels in connecting the dioramatic running toys.

Additionally, the connecting member has such simple construction that it is easy and economic to manufacture.

I claim:

1. A dioramatic running toy comprising;

a running member including a housing and a wheel assembly rotatably mounted to said housing;

a dioramatic panel having a top surface and a bottom surface and provided with through holes perforated from said top surface to said bottom surface for receiving said wheel assembly therein, said top surface comprising means portraying a scene which provides a setting for said running member; and connecting means for removably attaching said housing to said dioramatic panel with said wheel assembly received in said holes so as to enable said dioramatic panel to run with said running member.

2. A dioramatic self-propelled running toy comprising;

a running member including a housing and a wheel assembly rotatably mounted to said housing;

a dioramatic panel having a top surface and a bottom surface and provided with through holes perforated from said top surface to said bottom surface for receiving said wheel assembly therein, said top surface comprising means portraying a scene which provides a setting for said running member;

connecting means for removably connecting said running member to said dioramatic panel with said wheel assembly received in said holes and including a set of male type connectors provided on one of the dioramatic panel and said housing and a set of female type receptacles on the other; and a self-contained motor assembly mounted on said housing to drive said wheel assembly.

3. A dioramatic running toy assembly comprising;

at least a pair of dioramatic running toys; and connecting means for removably interconnecting said dioramatic running toys so as to make a dioramatic running toy assembly run in combination;

each said dioramatic running toy including a running member having a housing, a wheel assembly rotatably attached to said housing and a self-contained motor assembly mounted on said housing to drive said wheel assembly, a dioramatic panel having through holes for receiving said wheel assembly therein, and attaching means for removably attaching said housing to said dioramatic panel with said wheel assembly received in said holes so as to enable said dioramatic panel to run with said running member, said panel comprising means portraying a scene which provides a setting for said running member.

* * * * *